US007097151B2

(12) United States Patent
Akabane

(10) Patent No.: US 7,097,151 B2
(45) Date of Patent: Aug. 29, 2006

(54) ELECTROMAGNETIC FUEL INJECTION VALVE

(75) Inventor: Akira Akabane, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/227,424

(22) Filed: Sep. 16, 2005

(65) Prior Publication Data

US 2006/0086920 A1 Apr. 27, 2006

Related U.S. Application Data

(63) Continuation of application No. PCT/JP04/03719, filed on Mar. 19, 2004.

(30) Foreign Application Priority Data

Mar. 24, 2003 (JP) ..... 2003-79531
Mar. 26, 2003 (JP) ..... 2003-84857

(51) Int. Cl.
*F02M 51/06* (2006.01)

(52) U.S. Cl. ..... 251/129.18; 251/129.21

(58) Field of Classification Search ..... 251/129.18
See application file for complete search history.

(56) References Cited

U.S. PATENT DOCUMENTS 5,170,987 A * 12/1992 Krauss et al. ..... 251/129.21
5,289,841 A * 3/1994 Maranzano ..... 137/1
6,098,653 A * 8/2000 Kobow et al. ..... 137/454.5
2003/0201413 A1* 10/2003 Hirota et al. ..... 251/30.01
2004/0086391 A1* 5/2004 Hirota et al. ..... 417/222.2

FOREIGN PATENT DOCUMENTS

| | | | |
|---|---|---|---|
| JP | 59-221456 | | 12/1984 |
| JP | 63-125875 | | 5/1988 |
| JP | 63-171663 | | 11/1988 |
| JP | 3-116769 | | 12/1991 |
| JP | 7-501377 | | 2/1995 |
| JP | 8-49619 | | 2/1996 |
| JP | 9-303230 | | 11/1997 |
| JP | 11-200993 | | 7/1999 |
| JP | 2000-18135 | A | 1/2000 |
| JP | 2001-317429 | | 11/2001 |
| JP | 2002-4013 | A | 1/2002 |
| JP | 2002-31009 | A | 1/2002 |
| JP | 2002-89400 | A | 3/2002 |
| WO | WO 2004/085827 | * | 7/2004 |

* cited by examiner

*Primary Examiner*—J. Casimer Jacyna
(74) *Attorney, Agent, or Firm*—Arent Fox PLLC

(57) ABSTRACT

An electromagnetic fuel injection valve (I) is provided that includes a fixed core (5) made of a high hardness ferrite magnetic material, and a movable core (12) that has fixed thereto by press-fitting a stopper element (14) that is non-magnetic or is more weakly magnetic than the movable core (12), the stopper element (14) abutting directly against the fixed core (5) so as to maintain an air gap (g) between the two cores (5) and (12) when a coil (30) is energized. In this way, high abrasion resistance and responsiveness can be imparted to the fixed core and the movable core without subjecting the two cores to a troublesome abrasion resistance treatment to provide a plating layer, etc., and without providing a valve body stopper plate, thereby contributing to a reduction in the cost of the electromagnetic fuel injection valve.

7 Claims, 6 Drawing Sheets

ELECTROMAGNETIC FUEL INJECTION VALVE

This nonprovisional application is a continuation application of and claims the benefit of International Application No. PCT/JP2004/003719, filed Mar. 19, 2004. The disclosure of the prior application is hereby incorporated herein in its entirety by reference.

FIELD OF THE INVENTION

The present invention relates to an electromagnetic fuel injection valve used mainly in a fuel supply system of an internal combustion engine and, in particular, to an improvement of an electromagnetic fuel injection valve that includes a valve housing having a valve seat at one end thereof, a fixed core connected to the other end of the valve housing, a valve body housed within the valve housing and carrying out opening and closing operations in cooperation with the valve seat, a movable core integrally connected to the valve body and disposed so as to oppose the fixed core, a valve spring urging the valve body in a valve-closing direction, and a coil that is disposed so as to surround the fixed core and that by energization makes the fixed core attract the movable core, thereby opening the valve body.

BACKGROUND ART

Conventionally, it is known that, in such an electromagnetic fuel injection valve in which the movable core is attached directly onto the fixed core upon energization of the coil and a valve-opening limit for the valve body is thereby defined, since a large impact is imposed on the attached surfaces when the cores are attached to each other, a Cr, Mo, or Ni plating layer is formed in order to ensure abrasion resistance, as is disclosed in, for example, Patent Document 1. Furthermore, in order to avoid the two cores making contact with each other when the coil is energized, providing a stopper plate on the valve housing in order to define a valve-opening limit for the valve body is also known as disclosed in Patent Document 2.

[Patent Document 1] Japanese Patent Application Laid-open No. 63-125875

[Patent Document 2] Japanese Patent Application Laid-open No. 2002-89400

Such plating layers on the movable and fixed cores as disclosed in Patent Document 1 have to be formed by a plating step, which requires a long processing time; moreover, since the thickness of the plating layers is variable, it is necessary to correct the dimensions by polishing the plating layers, the number of steps increases, and it is difficult to reduce the cost of the electromagnetic fuel injection valve. Furthermore, as disclosed in Patent Document 2, providing the stopper plate on the valve housing results in increases in the number of components and the number of assembly steps, and this is also disadvantageous in terms of reducing the cost.

Patent Documents 3 to 5 below also disclose art related to electromagnetic fuel injection valves.

[3] Japanese Patent Application Laid-open No. 2002-4013

[4] Japanese Patent Application Laid-open No. 59-221456

[5] Japanese Patent Application Laid-open No. 9-303230

Patent Document 3 teaches a valve member having a movable core provided at one end thereof, the movable core abutting directly against an attracting face of a fixed core, and a valve portion provided on the other end of the valve member is housed in a valve seat member housed in a valve housing. There is no arrangement for alleviating the impact when the two cores are attracted to each other and, furthermore, a lengthwise hole is formed only in an upper part of the interior of the valve member, and there is no arrangement shown for reducing the weight and thus improving the responsiveness by means of this design.

Patent Document 4 shows a structure in which parts of a fixed core and a movable core that are attracted to each other are each press-fitted to a ring formed from a ceramic, etc., and when a valve is opened the ring projecting from the movable core is made to abut against the ring fixed to the fixed core. It is necessary to individually carry out mounting and fixing of the ring to the fixed core and the ring to the movable core, and forming such rings from a ceramic, etc. makes the structure complex and the assembly difficult and complicated. There are many factors that influence valve characteristics, such as adjustment of the amount of the ring projecting from the movable core and adjustment of the gap between the two rings, and the influence on the flow rate is a problem. Since the valve body does not have a journal portion for restricting movement thereof, the centering is poor, and the valve closing characteristics are variable.

Patent Document 5 teaches an arrangement in which a lengthwise hole is provided within a cylindrical valve body, and a lateral hole communicating with the lengthwise hole is formed in the vicinity of a valve portion of the valve body. Since the valve portion is conical, the centering is poor, and the valve closing characteristics are variable.

DISCLOSURE OF THE INVENTION

The present invention has been achieved under the above-mentioned circumstances, and it is an object of the present invention to provide an inexpensive electromagnetic fuel injection valve in which high abrasion resistance and responsiveness can be imparted to two cores without subjecting the two cores to a troublesome abrasion resistance treatment to provide a plating layer, etc., and without providing a valve body stopper plate in a valve housing.

Furthermore, it is another object of the present invention to provide an electromagnetic fuel injection valve in which, when a valve body and a movable core, which form a valve assembly, are formed integrally from the same material, good magnetic properties can be imparted to the valve assembly, excellent abrasion resistance can be imparted without carrying out any special abrasion resistance treatment, and at the same time the valve assembly can be made lightweight.

In order to attain these objects, in accordance with a first aspect of the present invention, there is provided an electromagnetic fuel injection valve that includes a valve housing having a valve seat at one end thereof, a fixed core connected to the other end of the valve housing, a valve body that is housed within the valve housing and that carries out opening and closing operations in cooperation with the valve seat, a movable core integrally connected to the valve body and disposed so as to oppose the fixed core, a valve spring urging the valve body in a valve-closing direction, and a coil that is disposed so as to surround the fixed core and that by energization makes the fixed core attract the movable core, thereby opening the valve body, the fixed core being made of a high hardness ferrite magnetic material, characterized in that a cylindrical stopper element is press-fitted and fixed to the movable core so that the stopper element projects toward the fixed core from an attracting face of the movable core, the stopper element surrounding the valve spring and being made of a stainless steel that is nonmagnetic or is more weakly magnetic than the movable core, and an end face of the stopper element and the attracting face of the movable core are simultaneously ground so that the stopper element defines a valve-opening limit for the valve body by the end face of the stopper element abutting against the attracting face of the fixed core when the coil is energized while maintaining an air gap between the attracting faces of the two cores, thus securing the air gap.

In accordance with this first aspect, when the coil is energized, as well as the valve body being maintained at the defined valve-opening limit by the end face of the cylindrical stopper element integrally attached to the movable core abutting against the attracting face of the fixed core, an appropriate air gap can be maintained between the attracting faces of the two cores and this, together with the stopper element being nonmagnetic or weakly magnetic, enables residual magnetization between the two cores to be quickly lost when the coil is de-energized, and the valve-closing responsiveness of the valve body can be improved.

Further, since the end face of the stopper element and the attracting face of the movable core are simultaneously ground to secure the air gap, when the coil is energized, the air gap between the attracting faces of the two cores formed by the end face of the stopper element abutting against the attracting face of the fixed core can be obtained precisely, in spite of the stopper element being press-fitted and fixed to the movable core, and the gap between the stopper element and the movable core can also be obtained precisely, thereby improving the valve-closing responsiveness of the valve body.

Furthermore, in addition to the first aspect, in accordance with a second aspect of the present invention, there is provided an electromagnetic fuel injection valve wherein the fixed core is made of an alloy containing 10 to 20% by weight of Cr, 0.1% by weight of Si, 1% by weight or more of at least one of Al and Ni, and ferrite Fe, Mn, C, P, and S as the remainder, the total of Al and Ni being 1.15 to 6% by weight.

In accordance with this second aspect, by machining alone of the alloy, a fixed core having high hardness and excellent abrasion resistance, and exhibiting a large magnetic force with a high magnetic flux density can be obtained, thereby contributing to a large improvement in the valve-opening responsiveness of the valve body.

Moreover, in addition to the first aspect, in accordance with a third aspect of the present invention, there is provided an electromagnetic fuel injection valve wherein the stopper element is press-fitted in a mating recess formed on the attracting face of the movable core so that a portion of the stopper element projects from the attracting face, and a tapered face or arc-shaped face is formed on the outer periphery of the extremity of the stopper element on the press-fitting side.

In accordance with this third aspect, the material of the stopper element can be freely selected from nonmagnetic materials irrespective of the material of the movable core and the valve body. Furthermore, the stopper element can be fixed to the movable core simply by press-fitting and, moreover, since the tapered face or arc-shaped face of the outer periphery of the extremity of the stopper element can be smoothly guided along the inner peripheral face of the mating recess when press-fitting, the formation of swarf can be prevented. Furthermore, by dimensional management of the amount of protrusion of the stopper element, the air gap can be obtained precisely and easily.

Furthermore, in addition to the first aspect, in accordance with a fourth aspect of the present invention, there is provided an electromagnetic fuel injection valve wherein the stopper element is formed integrally with the valve body so that the element is disposed so as to run through the movable core.

In accordance with this fourth aspect, the valve body and the stopper element can be made of a nonmagnetic or weakly magnetic material irrespective of the material of the movable core, and the durability of the valve body and the stopper element can be improved while at the same time enabling residual magnetization to be quickly lost when the coil is de-energized.

Moreover, in accordance with a fifth aspect of the present invention, there is provided an electromagnetic fuel injection valve that includes a valve housing formed from a cylindrical valve seat member having a valve seat at one end thereof, a magnetic cylindrical body coaxially extending rearward from the rear end of the valve seat member, and a nonmagnetic cylindrical body coaxially joined to the rear end of the magnetic cylindrical body, a fixed core connected to the other end of the valve housing, a valve body housed within the valve housing and having a valve portion that works in cooperation with the valve seat and a valve stem portion connected to the valve portion, a movable core connected to the valve stem portion and disposed so as to oppose the fixed core, a valve spring urging the valve body in a valve-closing direction, and a coil that is disposed so as to surround the fixed core and that by energization makes the fixed core attract the movable core, thereby opening the valve body, the valve body including the valve stem portion and the movable core being formed integrally from the same material so as to form a valve assembly, characterized in that the valve assembly is formed by forming the valve portion, the valve stem portion, and the movable core integrally from the same high hardness ferrite magnetic material, and press-fitting and fixing a cylindrical stopper element, which surrounds the valve spring and is made of a stainless steel that is nonmagnetic or more weakly magnetic than the movable core, to the movable core so that the stopper element projects toward the fixed core from the attracting face of the movable core, the valve seat is formed in a conical shape whereas the valve portion, which is seated thereon, is formed in a hemispherical shape, the valve assembly has a lengthwise hole and a lateral hole formed as fuel passages, the lengthwise hole starting from the end face of the stopper element and being blocked after passing through the center of a sphere of the hemispherical valve portion, and the lateral hole providing communication between the lengthwise hole and the interior of the valve housing, a journal portion is formed integrally with the valve stem portion in the vicinity of the center of the sphere of the valve portion, the journal portion being supported slidably on the inner peripheral face of the valve housing, and the lateral hole is made to open in the vicinity of the journal portion at a position closer to the valve seat than the center of the sphere of the hemispherical valve portion.

In accordance with this fifth aspect, the valve assembly, which is formed by forming the valve portion, the valve stem portion, and the movable core integrally from the same high hardness ferrite magnetic material, can exhibit good magnetic properties and high abrasion resistance, and the fuel injection characteristics can be stabilized over a long period of time. Furthermore, since the valve assembly does not require any special abrasion resistance treatment, the number of production steps can be reduced, and as well as there being a small number of components, the cost can be reduced.

Furthermore, whereas the valve seat is formed in a conical shape, the valve portion, which is seated thereon, is formed in a hemispherical shape, the journal portion is formed integrally with the vicinity of the center of the sphere of the valve portion, the journal portion being slidably supported on the inner periphery of the valve housing, and the opening and closing attitude of the valve is therefore stabilized, the centering of the valve body is secured, and the valve closing characteristics are improved.

Moreover, since the valve assembly has the lengthwise hole and the lateral hole formed as fuel passages, the lengthwise hole starting from the end face of the movable core and being blocked by the valve portion, and the lateral hole providing communication between the lengthwise hole and the interior of the valve housing, a substantial amount of surplus material can be eliminated from the valve assembly, the weight thereof can therefore be greatly reduced, and the responsiveness to magnetic force can be improved.

Moreover, since the lateral hole communicating with the lengthwise hole within the valve assembly is made to open on the outer peripheral face of the valve stem portion between the journal portion and the hemispherical valve portion at a position that is closer to the valve seat than the center of the sphere of the valve portion, it is possible to yet further reduce the weight of the valve assembly and improve the responsiveness, thus enabling a strong demand for reducing the dimensions of the injection valve to be satisfied. It also becomes easy to lubricate the journal portion, even if air bubbles become entrapped they can easily be discharged, and cooling of the valve assembly also becomes easy.

Furthermore, in addition to the fifth aspect, in accordance with a sixth aspect of the present invention, there is provided an electromagnetic fuel injection valve wherein the valve assembly is made of an alloy containing 10 to 20% by weight of Cr, 0.1% by weight of Si, 1% by weight or more of at least one of Al and Ni, and ferrite Fe, Mn, C, P, and S as the remainder, the total of Al and Ni being 1.15 to 6% by weight.

In accordance with this sixth aspect, by machining alone of the alloy, it is possible to form a valve body having high hardness and excellent abrasion resistance, and obtain a high performance valve assembly capable of exhibiting a large magnetic force with a high magnetic flux density.

Moreover, in addition to the fifth aspect, in accordance with a seventh aspect of the present invention, there is provided an electromagnetic fuel injection valve wherein the lateral hole opening on the outer peripheral face of the movable core is further provided.

In accordance with this seventh aspect, fuel is guided to the periphery of the movable core from the lengthwise hole via the lateral hole thereof, thus achieving lubrication and cooling of the movable core, and also enabling air bubbles generated around the movable core to be diverted to the lengthwise hole side via the lateral hole, thereby preventing the air bubbles from moving toward the valve seat.

The above-mentioned objects, other objects, characteristics, and advantages of the present invention will become apparent from an explanation of preferred embodiments that will be described in detail below by reference to the attached drawings.

BEST MODE FOR CARRYING OUT THE INVENTION

Preferred embodiments of the present invention are explained below with reference to the attached drawings.

Figure 1:
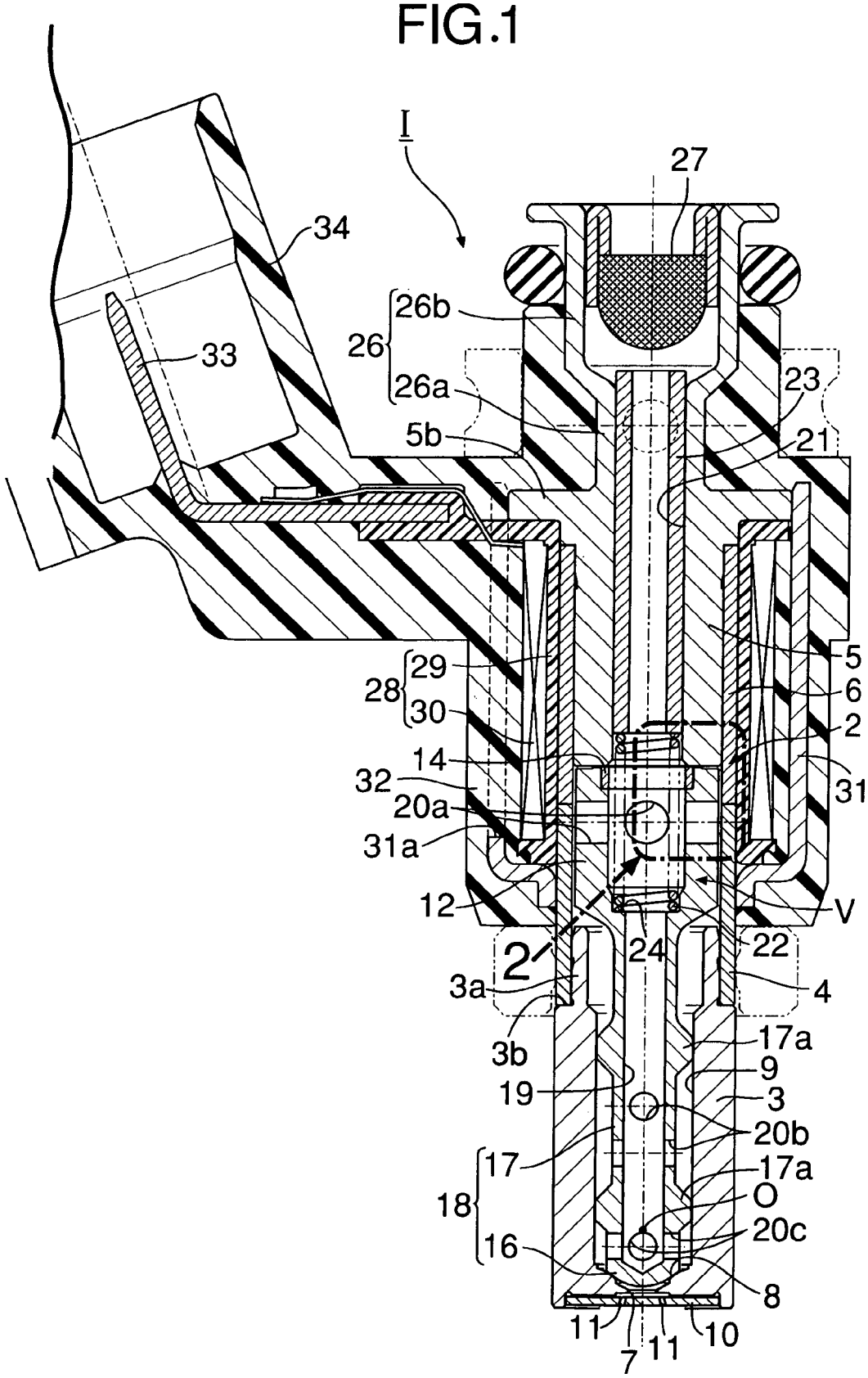
FIG. 1 is a vertical sectional view of an electromagnetic fuel injection valve for an internal combustion engine related to a first embodiment of the present invention.
Figure 2:
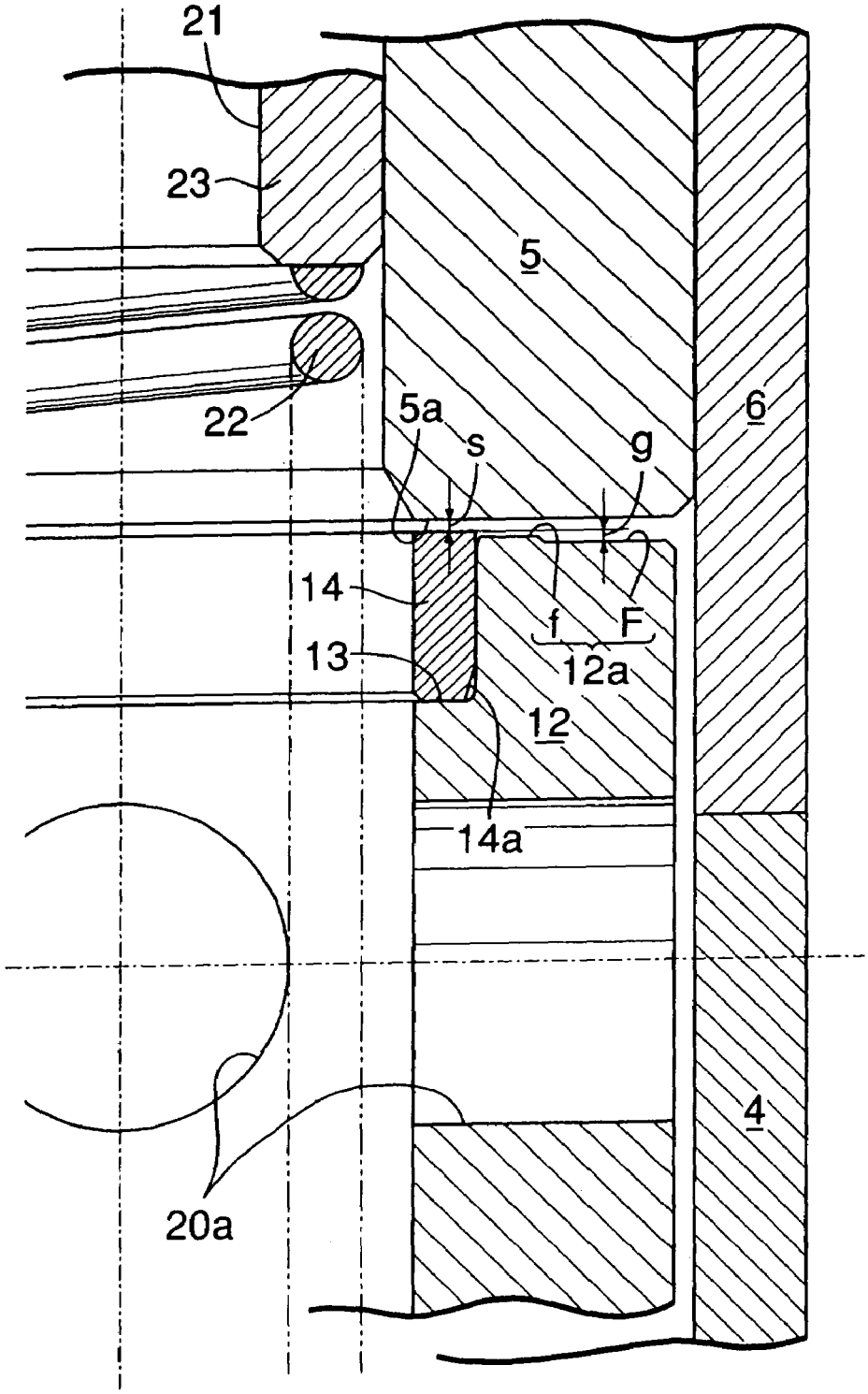
FIG. 2 is an enlarged view of a part 2 of FIG. 1.
Figure 3:
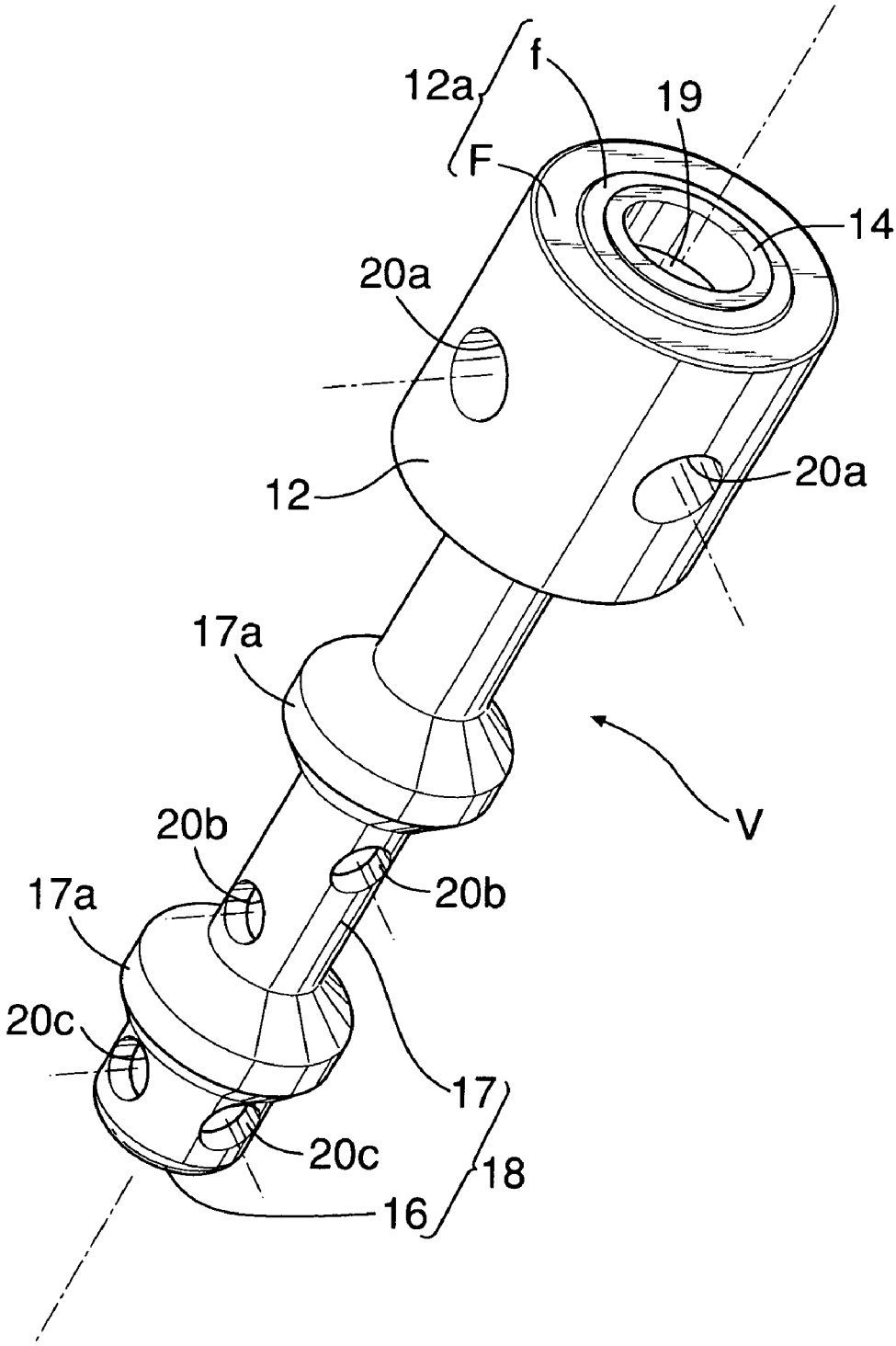
FIG. 3 is a perspective view of a valve assembly in FIG. 1.

A first embodiment of the present invention shown in FIG. 1 to FIG. 3 is now explained.

In FIG. 1, a valve housing 2 of an electromagnetic fuel injection valve I for an internal combustion engine is formed from a cylindrical valve seat member 3 having a valve seat 8 at its front end, a magnetic cylinder 4 coaxially joined to a rear end section of the valve seat member 3, and a nonmagnetic cylinder 6 coaxially joined to the rear end of the magnetic cylinder 4.

The valve seat member 3 has on its rear end section a linking tubular portion 3*a* that projects, with an annular shoulder portion 3*b*, toward the magnetic cylinder 4 from an outer peripheral face of the valve seat member 3. By press-fitting this linking tubular portion 3*a* in the inner peripheral face of the front end portion of the magnetic cylinder 4 so as to make the front end face of the magnetic cylinder 4 abut against the annular shoulder portion 3*b*, the valve seat member 3 and the magnetic cylinder 4 are joined to each other coaxially with a liquid-tight joint. The magnetic cylinder 4 and the nonmagnetic cylinder 6 are joined to each other coaxially with a liquid-tight joint by abutting opposing end faces against each other and laser beam welding all the way around.

The valve seat member 3 includes a valve opening 7 opening on its front end face, a conical valve seat 8 extending from the inner end of the valve opening 7, and a cylindrical guide hole 9 extending from a large diameter portion of the valve seat 8. Welded to the front end face of the valve seat member 3 with a liquid-tight weld is the entire periphery of a steel injector plate 10 having a plurality of fuel injection holes 11 communicating with the valve opening 7.

A hollow cylindrical fixed core 5 is fixed in a liquid-tight manner by press-fitting into the inner peripheral face of the nonmagnetic cylinder 6 from the rear end side thereof. In this arrangement, a part of the front end portion of the nonmagnetic cylinder 6 does not have the fixed core 5 fitted thereinto, and a valve assembly V is housed within the valve housing 2 extending from that part to the valve seat member 3.

As shown in FIG. 1 and FIG. 3, the valve assembly V is formed from a valve body 18 and a movable core 12. The valve body 18 includes a hemispherical valve portion 16 for opening and closing the valve opening 7 in corporation with the valve seat 8, and a valve stem portion 17 supporting the valve portion 16. The movable core 12 is connected to the valve stem portion 17, extends from the magnetic cylinder 4 into the nonmagnetic cylinder 6, and is inserted into these cylinders so as to coaxially oppose the fixed core 5. The valve stem portion 17 is formed so as to have a smaller diameter than that of the guide hole 9, and a pair of front and rear journal portions 17*a* are integrally formed on the outer periphery of the valve stem portion 17 so that the journal portions 17*a* project radially outward and are supported slidably on the inner peripheral face of the guide hole 9. In this arrangement, the journal portions 17*a* are disposed so as to form as large a gap as possible in the axial direction.

The valve assembly V is provided with a lengthwise hole 19, a plurality of first lateral holes 20*a*, a plurality of second lateral holes 20*b*, and a plurality of third lateral holes 20*c*. The lengthwise hole 19 extends from the rear end face of the movable core 12 to beyond the center O of the sphere of the hemispherical valve portion 16 and is blocked; the plurality of first lateral holes 20*a* provide communication between the lengthwise hole 19 and the outer periphery of the movable core 12, the plurality of second lateral holes 20*b* provide communication between the lengthwise hole 19 and the outer peripheral face of the valve stem portion 17 between the journal portions 17*a*, and the plurality of third lateral holes 20*c* provide communication between the lengthwise hole 19 and the outer periphery of the valve stem portion 17 that is toward the valve portion 16 relative to the front-side journal portion 17*a*. In this arrangement, the third lateral holes 20*c* are desirably disposed forward of the center O of the sphere of the valve portion 16, and the front-side journal portion 17*a* is desirably disposed as close as possible to the center O of sphere of the valve portion 16.

An annular spring seat 24 facing the fixed core 5 side is formed partway along the lengthwise hole 19.

The fixed core 5 has a lengthwise hole 21 communicating with the lengthwise hole 19 of the movable core 12, and has a fuel inlet tube 26 integrally connected to the rear end of the fixed core 5, the lengthwise hole 21 communicating with the interior of the fuel inlet tube 26. The fuel inlet tube 26 is formed from a reduced-diameter portion 26*a* extending from the rear end of the fixed core 5, and an enlarged-diameter portion 26*b* extending from the reduced-diameter portion 26*a*. A valve spring 22 is provided in compression between the spring seat 24 and a pipe-shaped retainer 23 inserted or lightly press-fitted into the lengthwise hole 21 from the reduced-diameter portion 26*a*, the valve spring 22 urging the movable core 12 in a direction to close the valve body 18. In this arrangement, the set load of the valve spring 22 is adjusted by the depth to which the retainer 23 is fitted into the lengthwise hole 21, and after adjustment the outer peripheral wall of the reduced-diameter portion 26*a* is partially crimped inward so as to fix the retainer 23 to the reduced-diameter portion 26*a*. A fuel filter 27 is mounted in the enlarged-diameter portion 26*b*.

The fixed core 5 and the valve assembly V are made of a high hardness ferrite magnetic material and, specifically, are formed by machining an alloy having the following composition.

C . . . 10 to 20% by weight

Si . . . 0.1% by weight

Al and Ni . . . both included, at least one thereof being 1% by weight or more, and the total thereof being 1.15 to 6% by weight Remainder . . . ferrite Fe and, as impurities, Mn, C, P, and S In this alloy, the total of Al and Ni being 1.15 to 6% by weight contributes in particular to improvements in the abrasion resistance, the magnetic force, and the responsiveness of the fixed core 5 and the valve assembly V. That is, about 95% of the total content of Al and Ni is a precipitate, and this greatly influences the hardness, the magnetic flux density, and the volume resistivity of the fixed core 5 and the valve assembly V. It is desirable for the hardness to be high in order to obtain the abrasion resistance, for the magnetic flux density to be large in order to increase the magnetic force, and for the volume resistivity to be small in order to improve the responsiveness.

Figure 5:
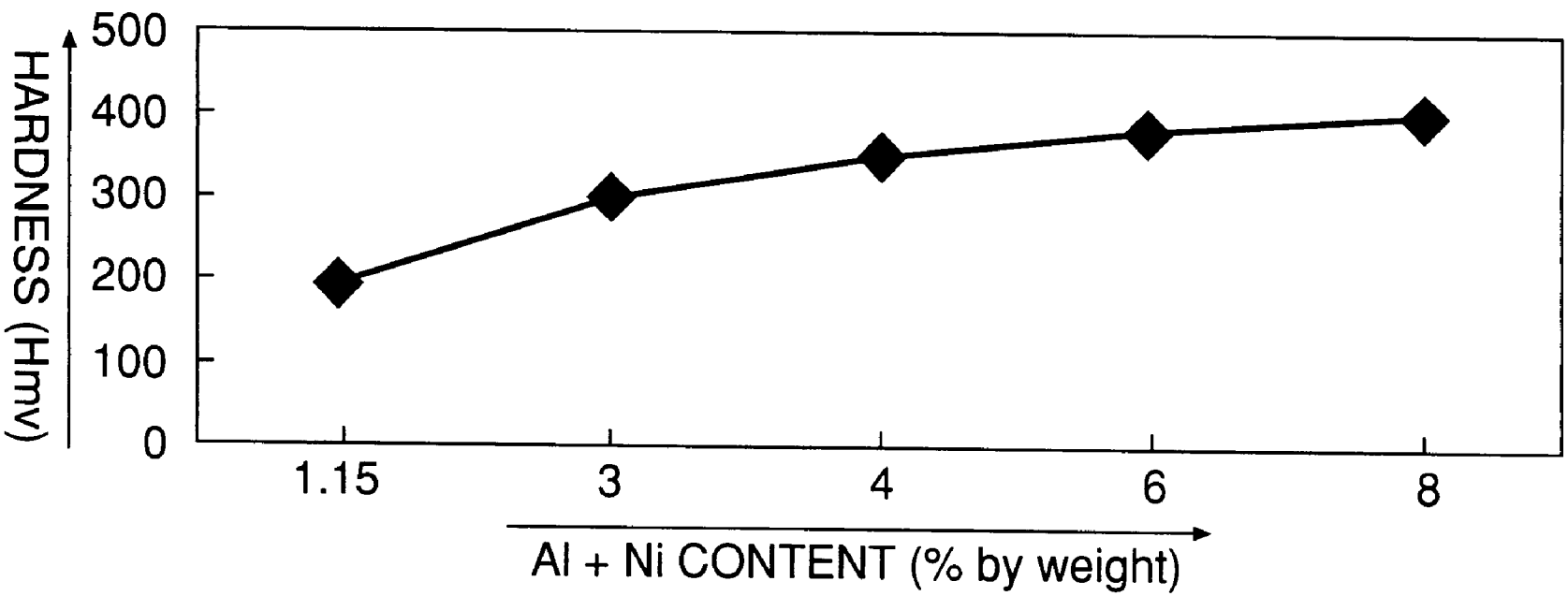
FIG. 5 is a graph showing the relationship between the hardness and the total content of Al and Ni of an alloy for a fixed core.

When the relationship between the hardness and the total content of Al and Ni of the alloy was examined experimentally, the result shown in the graph of FIG. 5 was obtained. When the relationships between the magnetic flux density and volume resistivity and the total content of Al and Ni of the alloy were examined experimentally, the results shown in the graph of FIG. 6 were obtained.

As is clear from FIG. 5, as long as the total content of Al and Ni is 1.15 to 6% by weight, the hardness of the alloy is 200 to 400 Hmv. This range of hardness is sufficient to impart adequate abrasion resistance to the fixed core 5 and the valve assembly V without subjecting them to any special abrasion resistance treatment such as plating after machining of the alloy. Since no special abrasion resistance treatment is required, the number of steps is decreased, and the cost of the fixed core 5 and the valve assembly V can be reduced.

Figure 6:
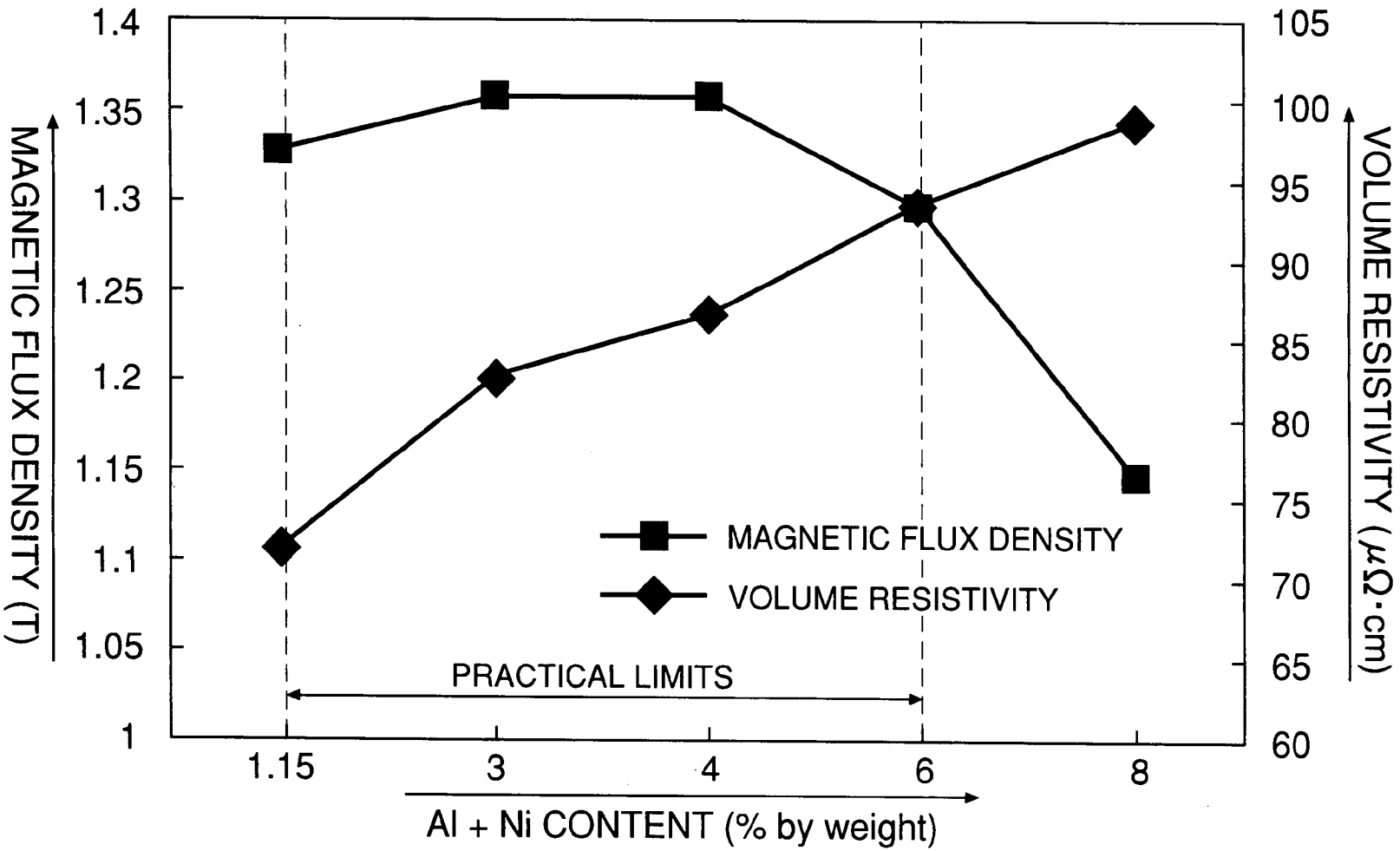
FIG. 6 is a graph showing the relationship between the magnetic flux density and volume resistivity and the total content of Al and Ni of the alloy for the fixed core.

As is clear from FIG. 6, when the total content of Al and Ni exceeds 6% by weight, not only does the magnetic flux density of the fixed core 5 and the valve assembly V decrease, thus making it difficult to obtain sufficient magnetic force, but also the flow of magnetic flux is delayed due to a decrease in the volume resistivity, thus reducing the responsiveness of the fixed core 5 and the valve assembly V.

Therefore, by setting the total content of Al and Ni to 1.15 to 6% by weight, the abrasion resistance, the magnetic force, and the responsiveness of the fixed core 5 and the valve assembly V can be made satisfactory in practice.

The Cr (10 to 20% by weight), Si (0.1% by weight), ferrite Fe and impurities Mn, C, P, and S as the remainder of the above alloy are those generally contained in a conventional core.

In the valve assembly V, as is clearly shown in FIG. 2, a mating recess 13 is formed on the attracting face 12*a* of the movable core 12 facing the attracting face 5*a* of the fixed core 5, and a collar-shaped stopper element 14 surrounding the valve spring 22 is press-fitted into the mating recess 13, or is fitted and then fixed into the mating recess 13 by welding or crimping. In the case of press-fitting, a tapered face 14*a* or an arc-shaped face is formed on the outer periphery of the extremity of the stopper element 14 on the press-fitting side. The stopper element 14 is made of a nonmagnetic material such as, for example, JIS SUS304.

The stopper element 14 projects from the attracting face 12*a* of the movable core 12, and is normally disposed so as to oppose the attracting face 5*a* of the fixed core 5 across a gap s corresponding to a valve-opening stroke of the valve body 18.

The attracting face 12*a* of the movable core 12 is formed from a reference attracting face F and a protruding attracting face f, the reference attracting face F facing the attracting face 5*a* across a predetermined air gap g when the stopper element 14 abuts against the fixed core 5, and the protruding attracting face f protruding from the reference attracting face F toward the fixed core 5.

The predetermined air gap g is set so that, when the coil 30 is de-energized from an energized state, the residual magnetic flux between the two cores 5 and 12 is quickly lost. The amount of protrusion of the protruding attracting face f relative to the reference attracting face F is set in a range such that, even when the stopper element 14 abuts against the fixed core 5, the protruding attracting face f does not make contact with the attracting face of the fixed core 5, and in this arrangement the area of the protruding attracting face f is set to be narrower than that of the reference attracting face F so that loss of residual magnetization is not hindered by the protruding attracting face f. In the example illustrated, the protruding attracting face f is formed in an annular shape so as to surround the stopper element 14, and the reference attracting face F is formed on the outer periphery of the protruding attracting face f.

The end face of the stopper element 14 and the reference and protruding attracting faces F and f are simultaneously finished by grinding after the stopper element 14 is mounted in the movable core 12. By so doing, the gap s and the air gap g, which are related to each other, can be obtained precisely.

Referring again to FIG. 1, a coil assembly 28 is fitted onto the outer periphery of the valve housing 2 so as to correspond to the fixed core 5 and the movable core 12. This coil assembly 28 is formed from a bobbin 29 and a coil 30, the bobbin 29 being fitted onto the outer peripheral faces of the rear end section of the magnetic cylinder 4 and the whole of the nonmagnetic cylinder 6, and the coil 30 being wound around the bobbin 29. The front end of a coil housing 31 surrounding the coil assembly 28 is welded to the outer peripheral face of the magnetic cylinder 4, and the rear end thereof is welded to the outer peripheral face of a yoke 5*b* that projects in a flange shape from the outer periphery of a rear end section of the fixed core 5. The coil housing 31 is cylindrical and has an axially extending slit 31*a* formed on one side thereof.

The coil housing 31, the coil assembly 28, the fixed core 5, and the front half of the fuel inlet tube 26 are sealed in by a synthetic resin cover 32 by injection molding. In this arrangement, the coil housing 31 is filled with the cover 32 through the slit 31*a*. A coupler 34 housing a connection terminal 33 connected to the coil 30 is integrally joined to a middle section of the cover 32.

The operation of the first embodiment is now explained.

When the coil 30 is in a de-energized state, the valve assembly V is pressed forward by the urging of the valve spring 22, the hemispherical valve portion 16 of the valve body 18 is seated on the conical valve seat 8, and a good valve-closed state can be always obtained by virtue of the centering action of the valve portion 16. Fuel pumped from a fuel pump (not illustrated) to the fuel inlet tube 26 passes through the interior of the pipe-shape retainer 23, the lengthwise hole 19, and the first to third lateral holes 20*a* to 20*c* of the valve assembly V, is held in readiness within the interior of the valve seat member 3, and is supplied for lubrication around the journal portions 17*a* of the valve body 18.

When the coil 30 is energized by passing electricity, the magnetic flux generated thereby runs sequentially through the fixed core 5, the coil housing 31, the magnetic cylinder 4, and the movable core 12, the movable core 12 of the valve assembly V is attracted by the fixed core 5 against the set load of the valve spring 22 by virtue of this magnetic force, the valve body 18 is detached from the valve seat 8, the valve opening 7 is opened, and high-pressure fuel within the valve seat member 3 is discharged from the valve opening 7 and injected through the fuel injection holes 11 toward an engine intake valve.

During this process, the stopper element 14 fixedly fitted into the movable core 12 of the valve assembly V abuts against the attracting face 5*a* of the fixed core 5, thus defining the valve-opening limit for the valve body 18, and the attracting face 12*a* of the movable core 12 faces the attracting face 5*a* of the fixed core 5 across the air gap g, thereby avoiding direct contact with the fixed core 5. In particular, by dimensional management of the amount of protrusion of the stopper element 14 relative to the attracting face 12*a* of the movable core 12, the air gap g can be obtained precisely and easily; this, together with the effect of the stopper element 14 being nonmagnetic, enables residual magnetization between the two cores 5 and 12 to be quickly lost when the coil 30 is de-energized, thereby improving the valve-closing responsiveness of the valve body 18.

Since the stopper element 14 is formed from a member separate from the movable core 12, a nonmagnetic material can be selected freely, irrespective of the material of the movable core 12 and the valve body 18.

Furthermore, the stopper element 14 can be fixed to the movable core 12 simply by press-fitting and, moreover, since the tapered face 14*a* or arc-shaped face of the outer periphery of the extremity of the stopper element 14 can be guided smoothly along the inner peripheral face of the mating recess 13 during press-fitting, formation of swarf can be prevented.

Since the fixed core 5 and the valve assembly V are made of a high hardness ferrite magnetic material as described above, the fixed core 5 and the movable core 12 of the valve assembly V cooperate so as to exhibit good magnetic properties, thereby improving the valve-opening responsiveness of the valve body 18. The fixed core 5 exhibits excellent abrasion resistance toward repetitive impact received from the stopper element 14, thus contributing to the valve-opening stroke of the valve body 18 being maintained appropriately over a long period of time. Furthermore, the valve portion 16 and the journal portions 17*a* of the valve body 18 of the valve assembly V exhibit excellent abrasion resistance toward abutment against the valve seat 8 and sliding in the guide hole 9, thereby making the operation of the valve body 18 stable over a long period of time.

Moreover, since the fixed core 5 and the valve assembly V, which are made of a high hardness ferrite magnetic material, do not require any special abrasion resistance treatment, the number of production steps is reduced. Furthermore, since the stopper element 14 is attached integrally to the movable core 12, the number of components and the number of assembly steps are not increased, and the cost is thus reduced.

Furthermore, the valve assembly V is provided, as fuel passages, with the lengthwise hole 19 that starts from the end face of the movable core 12 and is blocked by the valve portion 16, and the first to third lateral holes 20*a* to 20*c* that provide communication between the lengthwise hole 19 and the interior of the valve housing 2. In particular, since the lengthwise hole 19 extends beyond the center O of the sphere of the hemispherical valve portion 16 toward the vicinity of the surface of the extremity thereof, the fuel passages eliminate a substantial amount of surplus material of the valve assembly V, and as a result the weight of the valve assembly V is greatly reduced and the responsiveness to magnetic force can be improved.

Moreover, the first lateral holes 20*a* not only contribute to lubrication and cooling of the movable core 12 by guiding fuel to the periphery of the movable core 12 from the lengthwise hole 19, but also guide and divert air bubbles generated therein toward the lengthwise hole 19, thereby preventing effectively the air bubbles from moving toward the valve seat 8.

The second and third lateral holes 20*b* and 20*c* not only contribute to lubrication and cooling of the valve body 18 and, in particular, the journal portions 17*a* by guiding fuel from the lengthwise hole 19 to the peripheries thereof, but also guide and divert air bubbles generated therein toward the lengthwise hole 19, thereby preventing effectively the air bubbles from moving toward the valve seat 8.

Furthermore, since the attracting face 12*a* of the movable core 12 is formed from the protruding attracting face f, which has a small area, and the reference attracting face F, which has a large area, during the initial stages of energization of the coil 30, even when there is little magnetic flux generated, the magnetic flux is concentrated through the relatively small area of the protruding attracting face f, the magnetic flux density of the protruding attracting face f is increased, and the magnetic responsiveness of the movable core 12 is improved. Moreover, since the protruding attracting face f is in the central part of the movable core 12, the attractive force due to the magnetic force acts on the central part of the movable core 12, and its attitude when it starts to move can be stabilized. During later stages of energization when a large amount of magnetic flux is generated, the magnetic flux passes through both the protruding and reference attracting faces f and F, any increase in the magnetic resistance can be suppressed, and a large attractive force can be obtained. The valve-opening responsiveness of the valve body 18 can thus be improved.

A second embodiment of the present invention is now explained with reference to FIG. 4.

In this second embodiment, a valve body 18 and a movable core 12 of a valve assembly V are formed from separate members, and a cylindrical stopper element 14 and a flange 35 are integrally formed on a valve stem portion 17 of the valve body 18, the cylindrical stopper element 14 running through a linking hole 36 of the movable core 12 and being fixed to the movable core 12, and the flange 35 abutting against the front end face of the movable core 12 so as to restrict the depth to which the stopper element 14 is fitted into the movable core 12. Fixing of the stopper element 14 to the movable core 12 is carried out by press-fitting, crimping, or welding. In this case, the valve body 18 and the stopper element 14 are formed by machining a nonmagnetic material or a material that is more weakly magnetic than the movable core 12, such as a JIS SUS440C alloy.

Figure 4:
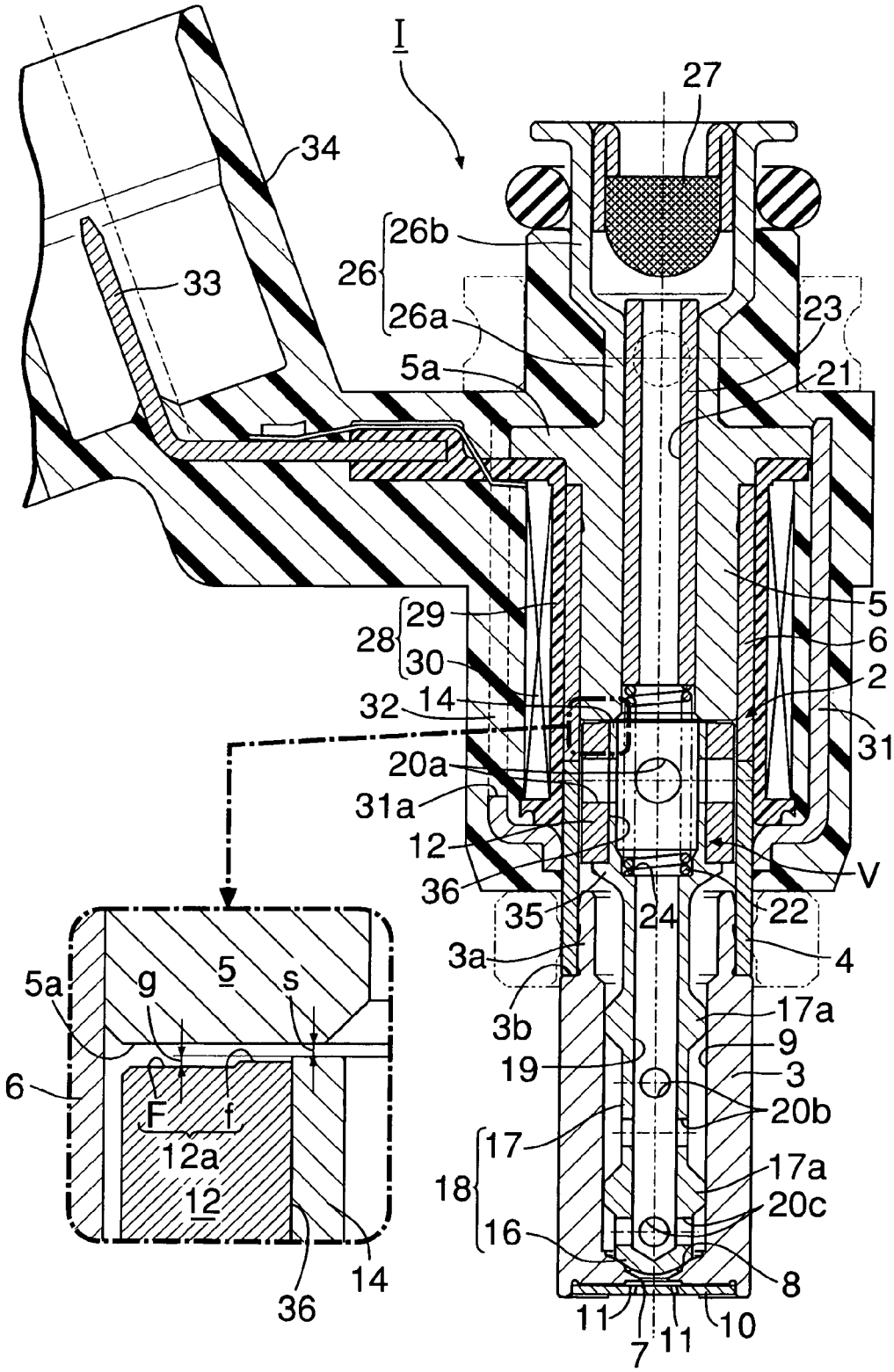
FIG. 4 is a sectional view, corresponding to FIG. 2, showing a second embodiment of the present invention.

The construction is otherwise basically the same as that of the preceding embodiment, and the same reference numerals and symbols as those used in the preceding embodiment are used in FIG. 4 to denote parts corresponding to the parts of the preceding embodiment, thereby avoiding duplication of the explanation.

In accordance with the second embodiment, it is possible to form the valve body 18 and the stopper element 14 from a high hardness nonmagnetic or weakly magnetic material irrespective of the material of the movable core 12, and the durability of the valve body 18 and the stopper element 14 can be improved while at the same time enabling residual magnetization between the two cores to be quickly lost when the coil is de-energized.

The present invention is not limited to the above-mentioned embodiments, and can be modified in a variety of ways without departing from the spirit and scope of the present invention. For example, instead of the rear-side journal portion 17*a* of the valve stem portion 17, a journal portion slidably supported by the inner peripheral face of the magnetic cylinder 4 can be formed on the outer peripheral face of the movable core 12.

The invention claimed is:

1. An electromagnetic fuel injection valve comprising a valve housing (2) having a valve seat (8) at one end thereof, a fixed core (5) connected to the other end of the valve housing (2), a valve body (18) that is housed within the valve housing (2) and that carries out opening and closing operations in cooperation with the valve seat (8), a movable core (12) integrally connected to the valve body (18) and disposed so as to oppose the fixed core (5), a valve spring (22) urging the valve body (18) in a valve-closing direction, and a coil (30) that is disposed so as to surround the fixed core (5) and that by energization makes the fixed core (5) attract the movable core (12), thereby opening the valve body (18), the fixed core (5) being made of a high hardness ferrite magnetic material;

characterized in that a cylindrical stopper element (14) is press-fitted and fixed to the movable core (12) so that the stopper element (14) projects toward the fixed core (5) from an attracting face (12*a*) of the movable core (12), the stopper element (14) surrounding the valve spring (22) and being made of a stainless steel that is nonmagnetic or is more weakly magnetic than the movable core (12), and an end face of the stopper element (14) and the attracting face (12*a*) of the movable core (12) are simultaneously ground so that the stopper element (14) defines a valve-opening limit for the valve body (18) by the end face of the stopper element (14) abutting against the attracting face (5*a*) of the fixed core (5) when the coil (30) is energized while maintaining an air gap (g) between the attracting faces (5*a*, 12*a*) of the two cores (5, 12), thus securing the air gap (g).

2. The electromagnetic fuel injection valve according to claim 1, wherein the fixed core (5) is made of an alloy containing 10 to 20% by weight of Cr, 0.1% by weight of Si, 1% by weight or more of at least one of Al and Ni, and ferrite Fe, Mn, C, P, and S as the remainder, the total of Al and Ni being 1.15 to 6% by weight.

3. The electromagnetic fuel injection valve according to claim 1, wherein the stopper element (14) is press-fitted in a mating recess (13) formed on the attracting face (12*a*) of the movable core (12) so that a portion of the stopper element (14) projects from the attracting face (12*a*), and a tapered face (14*a*) or arc-shaped face is formed on the outer periphery of the extremity of the stopper element (14) on the press-fitting side.

4. The electromagnetic fuel injection valve according to claim 1, wherein the stopper element (14) is formed integrally with the valve body (18) so that the element (14) is disposed so as to run through the movable core (12).

5. An electromagnetic fuel injection valve comprising a valve housing (2) formed from a cylindrical valve seat member (3) having a valve seat (8) at one end thereof, a magnetic cylindrical body (4) coaxially extending rearward from the rear end of the valve seat member (3), and a nonmagnetic cylindrical body (6) coaxially joined to the rear end of the magnetic cylindrical body (4), a fixed core (5) connected to the other end of the valve housing (2), a valve body (18) housed within the valve housing (2) and having a valve portion (16) that works in cooperation with the valve seat (8) and a valve stem portion (17) connected to the valve portion (16), a movable core (12) connected to the valve stem portion (17) and disposed so as to oppose the fixed core (5), a valve spring (22) urging the valve body (18) in a valve-closing direction, and a coil (30) that is disposed so as to surround the fixed core (5) and that by energization makes the fixed core (5) attract the movable core (12), thereby opening the valve body (18), the valve body (18) including the valve stem portion (17) and the movable core (12) being formed integrally from the same material so as to form a valve assembly (V);

characterized in that the valve assembly (V) is formed by forming the valve portion (16), the valve stem portion (17), and the movable core (12) integrally from the same high hardness ferrite magnetic material, and press-fitting and fixing a cylindrical stopper element (14), which surrounds the valve spring (22) and is made of a stainless steel that is nonmagnetic or more weakly magnetic than the movable core (12), to the movable core (12) so that the stopper element projects toward the fixed core (5) from the attracting face (12*a*) of the movable core (12), the valve seat (8) is formed in a conical shape whereas the valve portion (16), which is seated thereon, is formed in a hemispherical shape, the valve assembly (V) has a lengthwise hole and a lateral hole (20*c*) formed as fuel passages, the lengthwise hole (19) starting from the end face of the stopper element (14) and being blocked after passing through the center (O) of a sphere of the hemispherical valve portion (16), and the lateral hole (20*c*) providing communication between the lengthwise hole (19) and the interior of the valve housing (2), a journal portion is formed integrally with the valve stem portion (17) in the vicinity of the center (O) of the sphere of the valve portion (16), the journal portion (17*a*) being supported slidably on the inner peripheral face of the valve housing (2), and the lateral hole (20*c*) is made to open in the vicinity of the journal portion (17*a*) at a position closer to the valve seat (8) than the center (O) of the sphere of the hemispherical valve portion (16).

6. The electromagnetic fuel injection valve according to claim 5, wherein the valve assembly (V) is made of an alloy containing 10 to 20% by weight of Cr, 0.1% by weight of Si, 1% by weight or more of at least one of Al and Ni, and ferrite Fe, Mn, C, P, and S as the remainder, the total of Al and Ni being 1.15 to 6% by weight.

7. The electromagnetic fuel injection valve according to claim 5, wherein the lateral hole (20*a*) opening on the outer peripheral face of the movable core (12) is further provided.

* * * * *